US011201382B2

(12) United States Patent
Hoganson

(10) Patent No.: US 11,201,382 B2
(45) Date of Patent: Dec. 14, 2021

(54) DUCTED ANTENNA HOUSING FOR SMALL CELL POLE

(71) Applicant: Comptek Technologies, LLC, Boulder, CO (US)

(72) Inventor: Kenneth Michael Hoganson, Aurora, CO (US)

(73) Assignee: Comptek Technologies, LLC, Boulder, CO (US)

( * ) Notice: Subject to any disclaimer, the term of this patent is extended or adjusted under 35 U.S.C. 154(b) by 58 days.

(21) Appl. No.: 16/837,234

(22) Filed: Apr. 1, 2020

(65) Prior Publication Data

US 2021/0313665 A1 Oct. 7, 2021

(51) Int. Cl.

| | |
|---|---|
| ***H01Q 1/12*** | (2006.01) |
| ***H01Q 1/00*** | (2006.01) |
| *H01Q 1/24* | (2006.01) |

(52) U.S. Cl.

CPC ..... *H01Q 1/002* (2013.01); *H01Q 1/1228* (2013.01); *H01Q 1/246* (2013.01)

(58) Field of Classification Search

CPC ..... H01Q 1/002; H01Q 1/1228; H01Q 1/246; H01Q 1/12

See application file for complete search history.

(56) References Cited

U.S. PATENT DOCUMENTS

| | | | | |
|---|---|---|---|---|
| 4,224,082 | A | 9/1980 | Jacobson | |
| 6,167,673 | B1 | 1/2001 | Fournier | |
| 9,698,477 | B1 | 7/2017 | Jabara et al. | |
| 10,505,271 | B2 | 12/2019 | Constance et al. | |
| 10,763,575 | B2 | 9/2020 | Constance et al. | |
| 10,947,751 | B2 * | 3/2021 | Lockwood | F21S 8/086 |
| 2003/0233806 | A1 | 12/2003 | Ulrich | |
| 2004/0070985 | A1 | 4/2004 | Haddad | |
| 2009/0040750 | A1 | 2/2009 | Seth | |
| 2010/0023146 | A1 | 1/2010 | Hatano et al. | |
| 2010/0026604 | A1 | 2/2010 | Caldwell | |
| 2010/0231469 | A1 * | 9/2010 | Kim | H01Q 1/44 343/721 |
| 2015/0068711 | A1 * | 3/2015 | Kashihara | F24F 13/08 165/121 |
| 2015/0349399 | A1 * | 12/2015 | Lasier | H05B 47/19 343/721 |
| 2016/0146438 | A1 | 5/2016 | LaFemina | |
| 2017/0030571 | A1 | 2/2017 | Kawahara | |
| 2017/0122546 | A1 | 5/2017 | Abbott et al. | |
| 2017/0279187 | A1 * | 9/2017 | Lockwood | H01Q 1/246 |
| 2018/0077324 | A1 | 3/2018 | Adrain | |

(Continued)

*Primary Examiner* — Awat M Salih

(74) *Attorney, Agent, or Firm* — Russell Manning; FisherBroyles, LLP

(57) ABSTRACT

An antenna housing is provided that is configured to be mounted to a pole. The antenna housing has spaced upper and lower ends. A sidewall extends between and around the spaced ends to define an interior of the housing. This interior may house and/or partially conceal one or more antennas. Inlet and outlet ducting extend through the sidewall of the housing to individually cool each antenna within the interior of the housing. The inlet and outlet duct may connect to a cooling duct that is in fluid communication with a heat rejection surface of the antenna. Accordingly, each antenna may be cooled using ambient air and the heated air may be exhausted outside of the housing.

19 Claims, 10 Drawing Sheets

(56) References Cited

U.S. PATENT DOCUMENTS

| | | | | |
|---|---|---|---|---|
| 2018/0172229 | A1 | 6/2018 | Lockwood et al. | |
| 2018/0219278 | A1 | 8/2018 | Wigdahl et al. | |
| 2018/0351245 | A1* | 12/2018 | Constance | H01Q 1/44 |
| 2019/0137084 | A1 | 5/2019 | Kim et al. | |
| 2020/0118054 | A1 | 4/2020 | Bayges | |
| 2020/0136236 | A1 | 4/2020 | Colapietro et al. | |
| 2020/0190842 | A1 | 6/2020 | Ducros et al. | |

* cited by examiner

DUCTED ANTENNA HOUSING FOR SMALL CELL POLE

FIELD

The present disclosure is broadly directed to antenna housings utilized with small cell poles that provide coverage for local service areas. More specifically, the present disclosure is directed to antenna housings having internal ducting to provide venting for high power antennas.

BACKGROUND

In wireless communication networks, high-powered base stations (e.g., towers supporting antennas) commonly provide service over large geographic areas. Each base station is capable of serving wireless user devices in a coverage area that is primarily determined by the power of the signals that supported antennas can transmit. Frequently, high-powered base stations (e.g., macro stations) are located in a grid pattern with each base station mounting various antennas elevated on a tower. While such towers have previously provided adequate coverage for many wireless applications, such high-powered base stations tend to be too widely spaced for newer high-bandwidth wireless applications.

To improve wireless access, providers are moving toward smaller stations that provide enhanced coverage for more limited geographic areas. That is, to augment the coverage of the wireless network, wireless transceiver devices/antennas (e.g., access points) with relatively small coverage areas (and serving capacities) are deployed. Depending on their coverage area and serving capacities, these wireless transceiver devices are referred to as "femto" cells or "pico" cells. For simplicity and generality, the term "small cell pole" is used herein to refer to a wireless transceiver access point that is configured to serve wireless user devices over relatively small coverage areas as compared to a high-powered base station that is configured to serve a relatively large coverage area ("macro cell").

The increasing use of RF bandwidth or 'mobile data' has required a corresponding increase in the number of access points to handle the increased data. By way of example, 5G wireless networks promise greatly improved network speeds and are currently being planned and implemented. Such networks typically require shorter RF transmission distances compared to existing networks and thereby require more dense networks of access points. Along these lines, access points are, in some instances, being installed in urban areas to serve several city blocks or even to serve a single city block. Such installations are often below roof-top level of surrounding buildings. That is, access points are being installed at 'steel-level' sites typically on small poles. The increasing number of access points is sometimes referred to as densification of wireless infrastructure. Residents often object to such densification in their neighborhoods due to the aesthetic concerns of numerous small cell poles. To help alleviate aesthetic concerns, wireless providers often attempt to at least partially conceal antennas supported by such small cell poles within shrouding. Further, to address densification issues, wireless service providers continue to install more powerful 5G antennas capable of handling greater data loads and/or operating at increased transmission distances.

SUMMARY

The present disclosure is directed to vented or ducted antenna housings for installation on a small cell poles that are primarily configured to provide local coverage. Aspects of the disclosure are based on the realization that the use of more powerful antennas in conjunction with the incorporation of enclosing or shrouding of antennas to address aesthetic concerns can result in thermal management concerns within a small cell pole. That is, in many instances a plurality of antennas may be disposed within a small cell pole installation. When these antennas are enclosed within a shrouding, heat generated by operation of the antennas is at least partially contained within the shrouding. This can result in the antenna(s) operating in a thermal environment above recommended operation temperatures. Accordingly, the present disclosure is directed to an antenna housing and/or shrouding assembly that allows for individually venting antennas to reduce the temperature within an interior of an antenna housing. Along these lines, a ducting system is provided that more effectively removes heat from one or more antennas disposed within an antenna housing.

In one implementation, an antenna housing is provided. The antenna housing is primarily configured to be mounted to a pole. However, the antenna housing may be a modular housing such that it may be mounted to and/or support another antenna housing. The antenna housing has an upper end and a lower end that are spaced to define an interior volume there between. A sidewall or shroud extends between the upper end and lower end and typically extends around at least a portion of peripheries of the upper and lower ends of the housing. The upper end, lower end and sidewall collectively define an at least partially enclosed interior area of the housing. This at least partially enclosed interior of the antenna housing may house one or more antennas. Typically, such an antenna(s) is at least partially disposed within the interior of the antenna housing such that it is partially or fully concealed. That is, the antenna(s) is at least partially enclosed within a sidewall and/or shrouding of the housing that extends between its upper and lower ends. When housing an antenna, an active or emitting surface of the antenna is typically directed outward from the interior of the housing. In some arrangements, an emitting surface may be exposed through an aperture in the sidewall and/or shrouding. One or support structures or struts may extend between the upper end and lower end within the at least partially enclosed interior of the housing. Such support structures may provide mounting surfaces for the antenna(s).

In order to provide cooling, when an antenna is disposed within the housing, the housing further includes an inlet duct and an outlet duct. These ducts extend through the sidewall or shroud to draw air into the housing and exhaust air from the housing. Such sidewall entry and exit are required if the housing is modular such that the lower end is mounted to a pole or underlying housing and the upper end supports another housing or other component. Typically, each duct has a substantially hollow sidewall that extends between an inlet end and an outlet end. The shape of the inlet and outlet ends as well as the shape of the duct sidewall may be selected based on intended use. By way of example, the outlet end of the inlet duct may be configured to engage a specific antenna unit disposed within the housing. Most commonly, the inlet and outlet ducts connect to a cooling duct within the interior of the housing. The inlet, cooling and outlet duct provide a closed (e.g., substantially sealed) airflow path into and out of the housing. To remove heat from an antenna, an interior of the cooling duct is typically in fluid communication with a heat rejecting surface of an antenna. In an arrangement, the cooling duct may be integrally formed within an antenna unit. In another arrangement, the cooling duct may have an opening that engages (e.g., receives) a surface of an antenna unit. In an arrangement, a blower or fan may be disposed within the closed airflow path to provide circulation through the airflow path.

In an arrangement, the upper and lower ends of the housing are formed of annular end plates, which need not be circular (e.g., octagonal). The annular end plates include one or more interior apertures that permit the passage of cables through the antenna housing. In one arrangement, the annular end plates include a plurality of apertures around their periphery to allow for connection to the pole, adjacent antenna housings or other structures. The plurality of apertures permit adjacent antenna support sections to be rotated relative to one another such that supported antennas may be directed in different directions.

In an arrangement, the sidewall extending between the upper and lower ends of the housing may be made of multiple independent sections. Such section may be termed shrouds. Each shroud may include an antenna aperture for exposing an emitting surface of an antenna within the interior of the housing. Each shroud may also include an inlet opening connectable to the inlet duct and an outlet opening connectable to the outlet duct.

In an arrangement, the housing is configured to support three antennas disposed at 120 sectors. In such an arrangement, the housing may include three sets of inlet and outlet ducts. Each set of ducts may provide individual cooling for one of the antennas.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

The present disclosure is broadly directed to wireless antenna housings that are primarily intended for use with small cell poles in urban environments. In various embodiments, the antenna housings are configured to at least partially conceal supported wireless antennas within an enclosed interior of the housing to minimize their aesthetic obtrusiveness. Various embodiments of the present disclosure are related to the recognition by the inventor that the use of increasingly more powerful wireless antennas in conjunction with the enclosing or shrouding of the antennas can result in thermal concerns within a small cell pole. That is, when one or more antennas are at least partially concealed within an enclosed interior of an antenna housing, heat generated during operation of the antenna(s) tends to build up within the housing. This can result in the antenna(s) operating in a thermal environment above recommended operation temperatures. Accordingly, the present disclosure is directed to an antenna housing and/or shrouding assembly that allows for individually venting antennas to reduce the temperature within an interior of the antenna housing and/or shrouding. More specifically, a ducting system is provided that more effectively removes heat from one or more antennas disposed within an interior or antenna housing.

Figure 1:
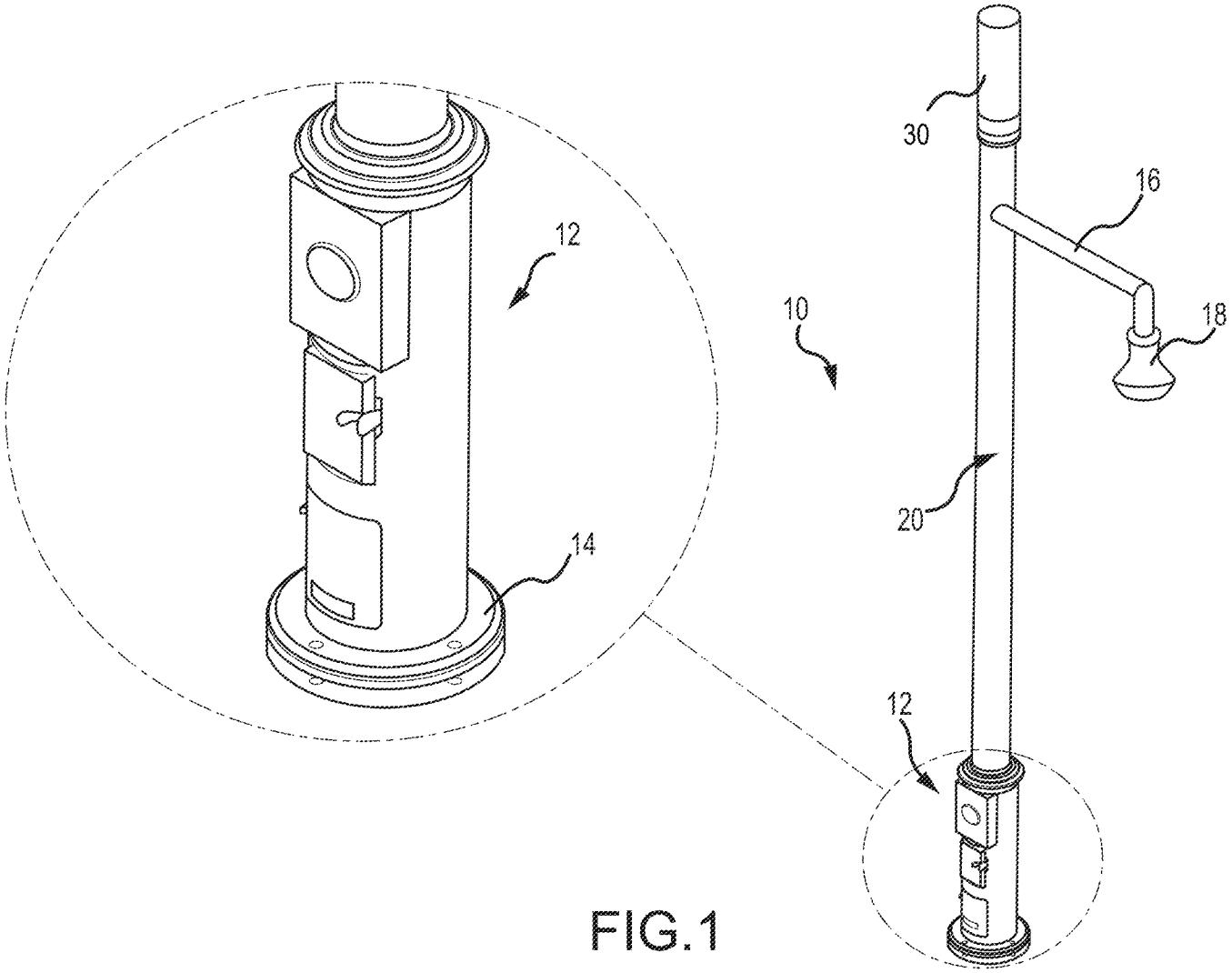
FIG. 1 illustrates one embodiment of a small cell pole.

FIG. 1 illustrates one embodiment of a small cell pole 10. Various features of this small cell pole are disclosed in co-owned U.S. Patent Publication No. 2017/0279187, the entire contents of which are incorporated herein by reference. As shown, the cell pole includes a lower equipment housing 12 that includes an inner cavity (e.g., interior) configured to house, for example, cell control equipment. The equipment housing 12 has a lower flange 14 used to mount the housing to a surface (e.g., ground). Other installation methods are possible. Access panels and/or doors may be mounted to the equipment housing 12 to enclose equipment from the elements, while providing selective access, when desired, to modify, regulate, change out, or otherwise access the equipment within the housing 12. The housing may include locks, hinges, access doors, vents for passive radiant cooling, and/or viewing ports. Cable ports and other features may be formed therein during manufacture.

Fasteners, such as threaded posts or bolts, are formed on an upper surface (e.g., flange; not shown) of the equipment housing 12 to facilitate attachment of a pole 20, which may support an antenna housing 30. In an embodiment, the antenna housing may include, for example, an omnidirectional antenna disposed within an RF transparent shroud that conceals the antenna. The cell pole 10 has a two-part design: the lower equipment housing 12 and the pole 20. The two-part construction allows for easier construction and implementation during set-up. That is, the equipment housing 12 can be installed separately from the pole 20 and/or antenna housing 30. Additionally, any equipment contained in the equipment housing may be installed at a later time. The present embodiment also illustrates a light mast or arm 16 attached to an upper portion of the pole 20. The illustrated light mast 16 supports a street light 18. As set forth in U.S. Patent Publication No. 2017/0279187, the interior of the equipment housing 12 may open into the generally hollow interior of the pole 20. This allows passage of cables from the equipment housing(s) into the center of the pole for routing to, for example, one or more antennas and/or lights.

Figure 2:
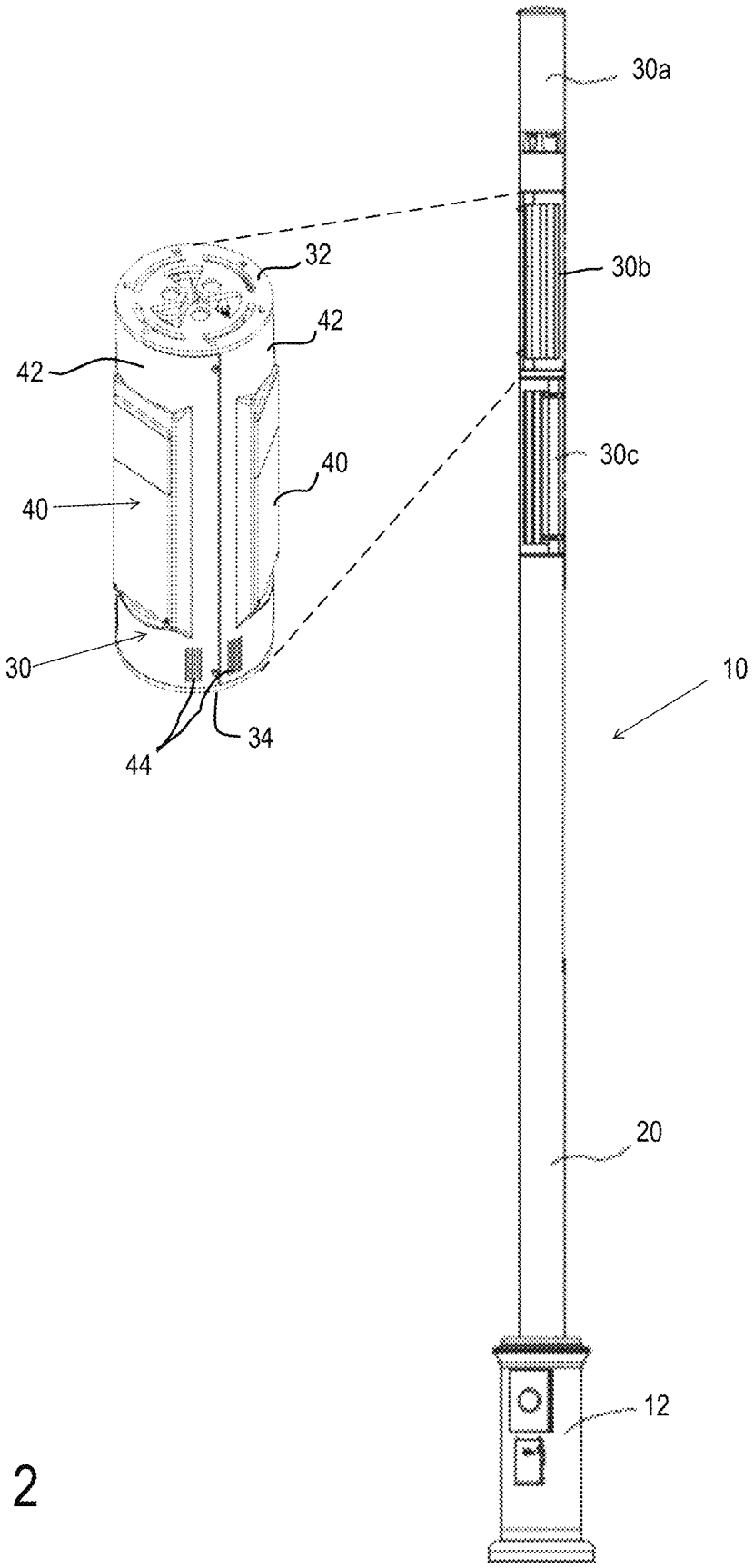
FIG. 2 illustrate one embodiment of a small cell pole having vertically stacked antenna housings.

To better utilize a location where a small cell pole is located (e.g., access point), it is becoming increasingly common for a cell pole to support two or more sets of antennas, which may be disposed in vertically stacked antenna housings. In such an arrangement, wireless antennas of two or more separate wireless providers may be supported by a single pole. FIG. 2 illustrates one embodiment of a small cell pole 10 that houses separate sets of antennas that are disposed in vertically stacked antenna housings. As illustrated, this embodiment of the cell pole 10 includes a lower equipment housing 12, a support pole section or 'monopole' 20 and three antenna support housings 30*a*-30*c* (hereafter 30 unless specifically referenced).

As illustrated in FIG. 2, a lower end of the monopole 20 is connected to the equipment housing 12. Though illustrated as including the lower equipment housing 12, it will be appreciated that not all embodiments of the cell pole 10 require such a lower equipment housing. Along these lines, the lower end of the monopole 20 may be configured for attachment to a ground surface and/or a subterranean equipment vault. An upper end of the monopole 20 is connected to and supports the lower end of the lower antenna housing 30*c*. An upper end of the lower antenna housing 30*c* is connected to and supports the lower end of a middle antenna housing 30*b*, which likewise supports and upper antenna housing 30*a*. Though illustrated as having three antenna housings, it will be appreciated that the pole may support fewer antenna housings or more antenna housings. As shown, the use of the individual antenna housings allows the cell pole 10 to be a modular system that allows for adding additional antenna sections as desired. For instance, different wireless providers may utilize different antenna housings and/or different antenna housing may provide antenna coverage for different azimuth directions.

Figure 3:
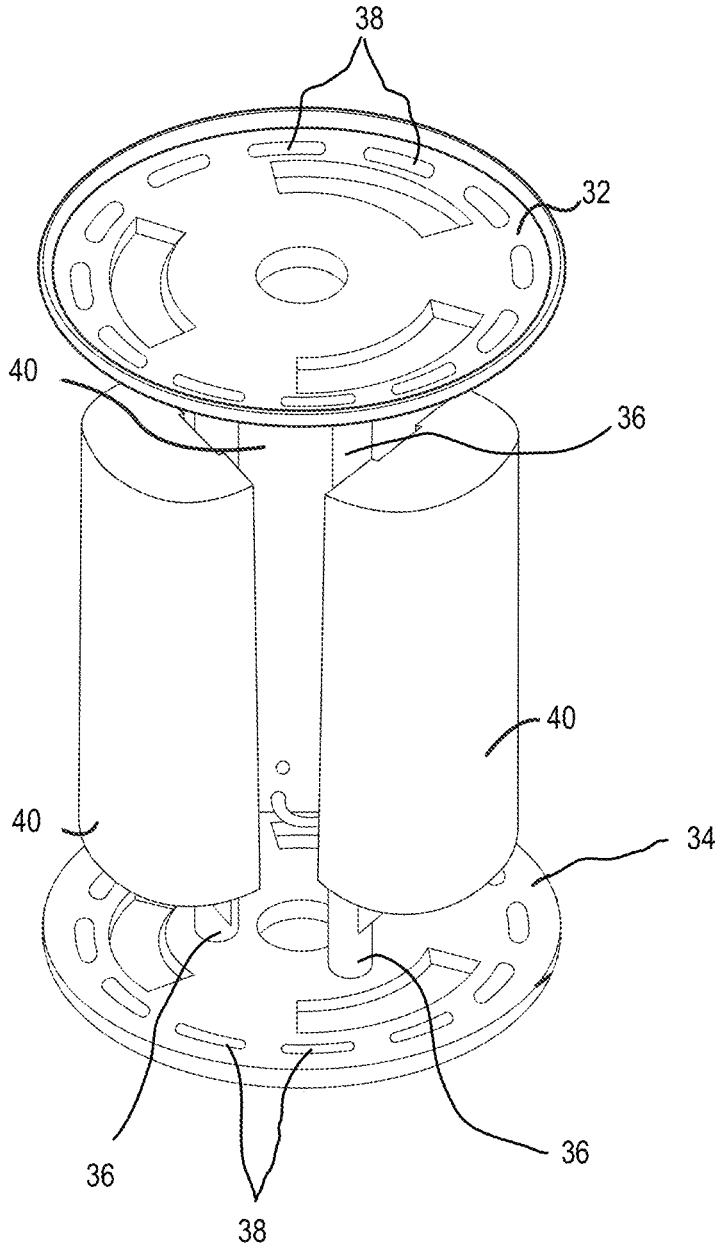
FIG. 3 illustrates an interior of one embodiment of an antenna housing.

FIG. 3 illustrate one embodiment of an antenna housing 30 with external shrouding removed for illustration. The antenna housing 30 includes an upper end and a lower end. More specifically, the antenna housing includes an upper annular plate 32 and a lower annular plate 34, respectively. The two plates 32, 34 each include multiple apertures, which permit the extension of wiring or cabling (not shown) through the antenna housing(s), when the small cell pole is assembled. Further, these apertures provide a pathway for airflow (e.g., natural or forced convection) through the antenna housing. As shown the two plates 32, 34 are disposed in a spaced relationship to define an interior volume there between. This interior volume is sized to house one or more antenna units 40 therein.

In the illustrated embodiment, three structural supports or struts 36 extend between the upper plate 32 and lower plate 34. The ends of the struts 36 are fixedly attached (e.g., welded, bolted, integrally formed, etc.) to each plate. As will be appreciated, when utilized in an assembled cell pole, the antenna housing 30 may become a structural member that supports structures attached to its upper end such as, for example, upper antenna housings, lights etc. Thus, the antenna housing may be required to support loads such as compressive loads and/or moment loads (e.g., wind loading) applied by supported structures or elements. Accordingly, the struts 36 may include various bracing with the plates to provide adequate structural rigidity. Further, it will be noted that when multiple antenna housings are provided in a single cell pole, the configuration of adjacent antenna housings may be different. For instance, a lower housing may have thicker plates and/or struts (e.g., to support greater loads) while upper antenna housings may have thinner plates and/or struts and/or be made of different materials.

In the illustrated embodiment, the struts 36 also form antenna mounts, though separate antenna mounts are possible and considered within the scope of the present disclosure. The antenna units 40 supported by the antenna housing 30 may each have brackets (not shown) that are configured to attach to at least one of the struts. In various embodiments, such brackets may be affixed to the strut 36 when an antenna unit 40 is in a desired position. This may allow for fine-tuning the directionality of the antenna. The illustrated embodiment of the antenna housing 30 is configured to support three antennas units 40. These three antennas may provide 360-degree coverage (e.g., three 120-degree sector antennas).

To further permit fine directional tuning of antennas supported by the illustrated antenna housing 30, the upper and lower plates 32, 34 may each include a plurality of apertures 38 disposed about their periphery. These apertures 38 allow for connecting the antenna housing 30 to structures above and below utilizing one or more fasteners (e.g., bolts). Further, the apertures 38 allow for rotating each antenna housing relative to one or more adjacent antenna housings to align two or more adjacent antennas in different azimuth directions prior to affixing their relative positions, for example, by tightening one or more fasteners. Accordingly, this additional adjustment provides fine-tuning of the direction of antennas supported by the antenna housing 30. A similar antenna housing to the one illustrated in FIG. 3B is set forth in co-owned U.S. Pat. No. 10,505,271, the entire contents of which are incorporated herein by reference.

Once the antennas units 40 are disposed within the antenna housing 30, the antenna units may be at least partially enclosed within the interior of the housing. In an embodiment, one or more shrouds 42 extend around the periphery of the housing and between the upper and lower plates. See FIG. 2. Effectively, the shrouds define a sidewall of the antenna housing between its upper end and its lower end. Though utilizing the term 'shroud', it will be appreciated that any component that at least partially encloses the antenna(s) within an interior of the housing between its upper and lower ends may be utilized. In any embodiment, it may be desirable to at least partially conceal the antennas to provide a finished look and to allow the resulting small cell pole to better blend in with its surroundings. If the shroud(s) covers an active surface of the antenna(s), the covering portion of the shroud is typically made of a material that is substantially transparent (e.g., transmission of greater than 90%) to radiofrequency (RF) waves. Such RF transparent materials include, without limitation, fiber glasses, polymers and/or fabrics. In other arrangements, the shroud 42 may have an antenna aperture 46 that exposes an active or emitter surface of the antenna unit 40. See, e.g., FIG. 4B.

As previously noted, wireless providers continue to increase the power of the antennas utilized for local coverage. By way of example, previous generations of antennas (e.g., 4G antennas) often had operational powers of around 150 watts. When an antenna housing held three such antennas, the total power of the enclosed antennas would be 450 watts. A thermal load generated by the enclosed antennas could be managed by providing vents 44 at or near the bottom of the housing 30. See FIG. 2. Such vents 44 permit removal of heat from the housing via natural or forced convention. However, newer antennas (e.g., 5G antennas) having higher operational power (e.g., 400-500 watts) produce more heat than can be removed utilizing such simplified venting. For example, an antenna housing supporting three antennas has an operation power of 1200-1500 watts. When the antennas are enclosed within a shrouding, the heat generated during operation tends to build up. This is further complicated in applications where antenna housings are vertically stacked. Specifically, heat from a lower housing 30*c* tends to move upward into an upper housing 30*b*, further increasing the temperature within the upper housing. Accordingly, it is desirable to more effectively vent heat generated by each antenna from the antenna housing.

Figure 4A:
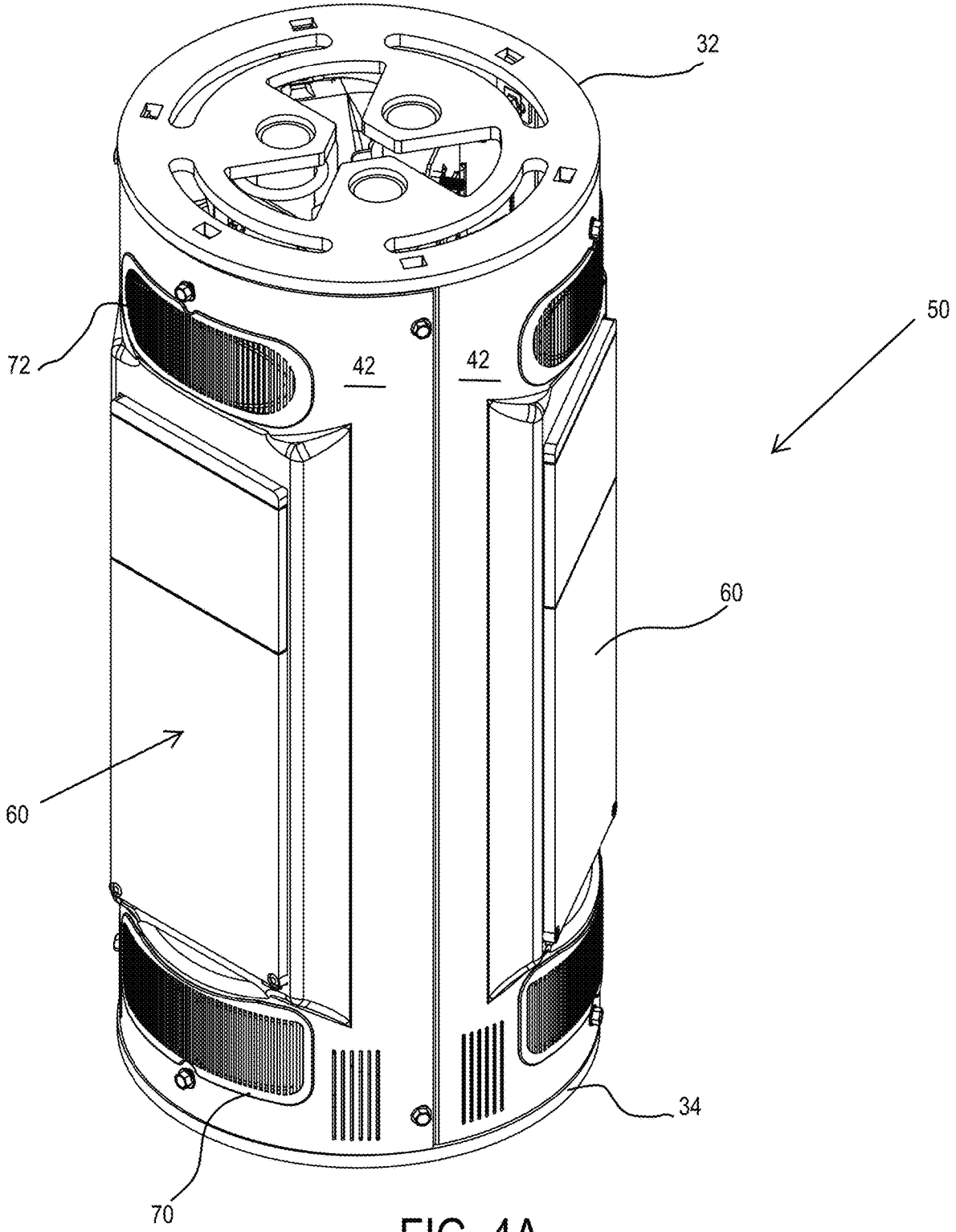
FIG. 4A illustrates one embodiment of a ducted antenna housing.
Figure 4B:
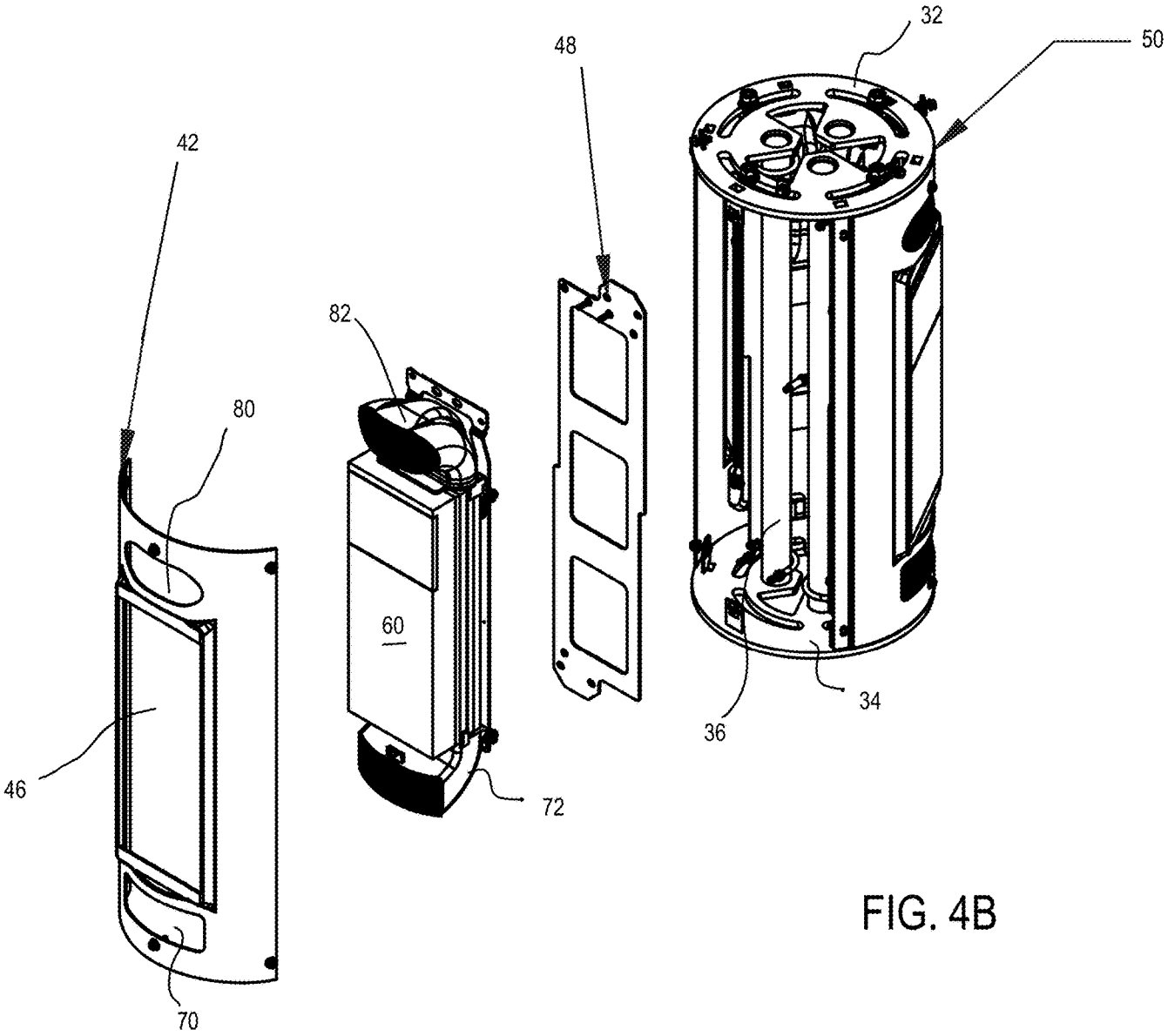
FIG. 4B illustrates a partially exploded view of FIG. 4A.

FIGS. 4A and 4B illustrate one embodiment of an antenna housing 50 that provides individual venting for each supported antenna. As illustrated, the antenna housing 50 shares many components with the antenna housing 30 described in FIGS. 2 and 3 and common reference numbers are utilized to refer to the common components. As above, the antenna housing 50 includes an upper end 32, a lower end 34 and a plurality of struts 36 extending there between. Further, the antenna housing 50 supports three antenna units 60 that are at least partially enclosed within the housing 50 by three shrouds 42 that generally define a sidewall or peripheral surface of the antenna housing between the upper end 32 and lower end 34. In the illustrated embodiment, each antenna unit 60 attaches to two of the struts 36 via a mounting bracket 48. In addition, the illustrated antenna housing 50 includes, for each supported antenna, a lower air intake vent 70 and an upper air outlet vent 80, each extending through the sidewall or shroud 42 covering the antenna unit 60. The intake vent 70 fluidly connects to an air inlet duct 72 that extends from the intake vent to a cooling duct (not shown) disposed near the bottom of the antenna 60. Likewise, the outlet vent 80 fluidly connects to an air outlet duct 82 that extends from the outlet vent to the cooling duct (not shown) disposed near the top of the antenna 60. The vents and ducts allow for individually cooling each antenna by drawing ambient air into the housing, passing the air over a heat rejection surface of the antenna and expelling the heated air from the housing.

Figure 5A:
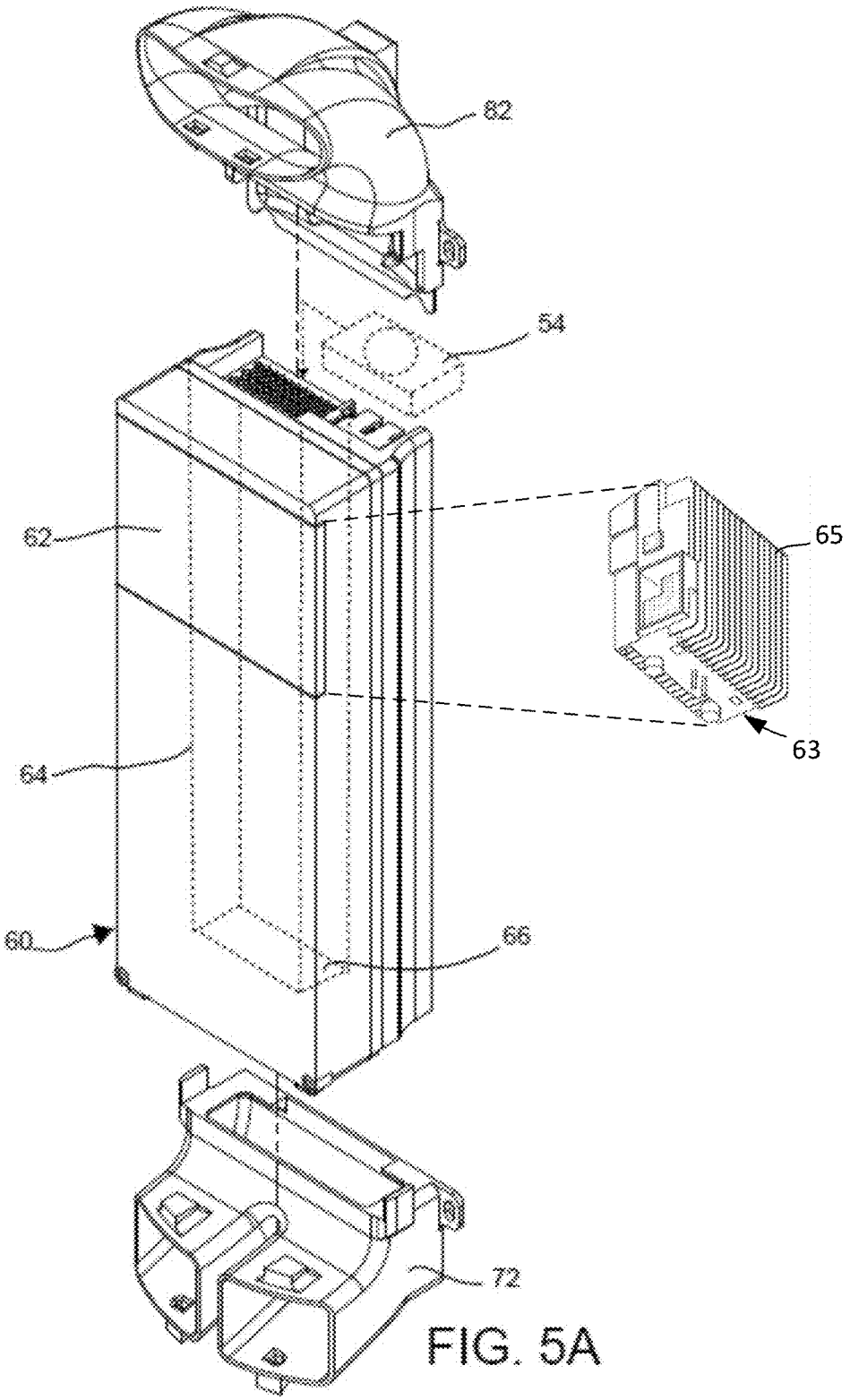
FIGS. 5A and 5B illustrate connection of inlet and outlet ducts to a wireless antenna unit.
Figure 5B:
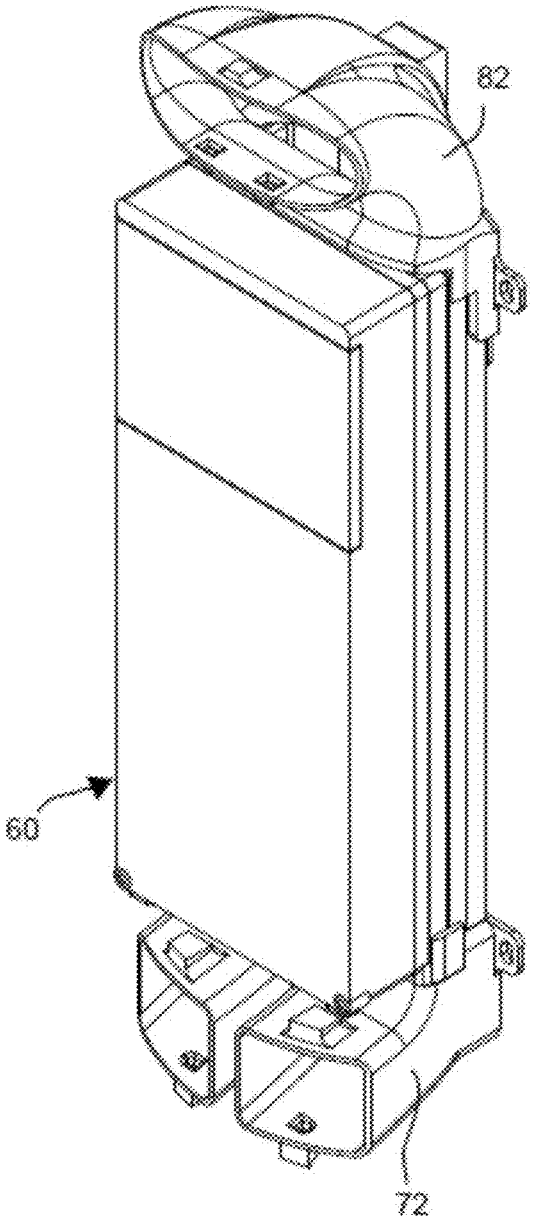

FIGS. 5A and 5B illustrate connection of the inlet duct 72 and outlet duct 82 to the antenna unit 60 having an integrally formed cooling duct. In the illustrated embodiment, the antenna unit 60 is a Streetmacro 6701 antenna produced by Ericsson. It will be appreciated that the antenna housing disclosed herein may be utilized with a variety of antenna units and that this particular antenna unit is presented by way of example only. Nonetheless, the Streetmarco antenna unit is representative of the general form of many 5G antenna units currently being installed. As illustrated, the antenna unit 60 includes a generally rectangular prism-shaped housing. A forward surface of the antenna unit 60 includes a front panel or radome 62, which is a thin walled RF transparent area that protects the forward emitting surface of an RF antenna 63. The housing of the antenna unit 60 includes an internal cooling duct 64 that passes through the rearward portion of the housing from an inlet 66 in the bottom surface to an outlet 68 in the top surface. The cooling duct passes over a heat rejection surface disposed within the interior of the antenna unit 60. The heat rejection surface may be a finned surface 65 (e.g., aluminum) attached to a rearward surface of the antenna 63. Commonly, the antenna unit will include a fan (not shown) to move air through the cooling duct 64 from the inlet 66 to the outlet 68. Such air passes over the heat rejection surface cooling the antenna.

In the absence of the inlet duct 72 and outlet duct 82, heat from internal cooling duct 64 of the antenna unit 60 would be drawn from the interior of the antenna housing 50 and expelled back into the interior of the antenna housing. This would result in inefficient cooling of the antenna and an increasing temperature within the antenna housing. To allow for drawing ambient air from outside of the antenna housing 50 to cool the antenna unit 60, the inlet duct 72 is attached to the bottom surface of the antenna unit 60 such that a hollow interior of the inlet duct 72 is in fluid communication with the inlet 66 of the antenna cooling duct 64. Likewise, to allow for exhausting air from the antenna housing, after the air passes over the heat rejection surface of the antenna unit 60, the outlet duct 82 is attached to the top surface of the antenna unit such that a hollow interior of the outlet duct 82 is in fluid communication with the outlet 68 of the antenna cooling duct 64. That is, once connected to the cooling duct 64 of the antenna unit 60, the ducts 72, 82 each vent through a sidewall surface (e.g., shroud) of the antenna housing. More specifically, air from outside the housing enters the inlet duct 72, passes through the antenna duct 64, passes through the outlet duct 82 and exhausts outside of the housing. The air used to cool the antenna never comingles with air in the interior of the housing. This arrangement significantly reduces the internal temperature of the antenna housing.

Figure 6B:
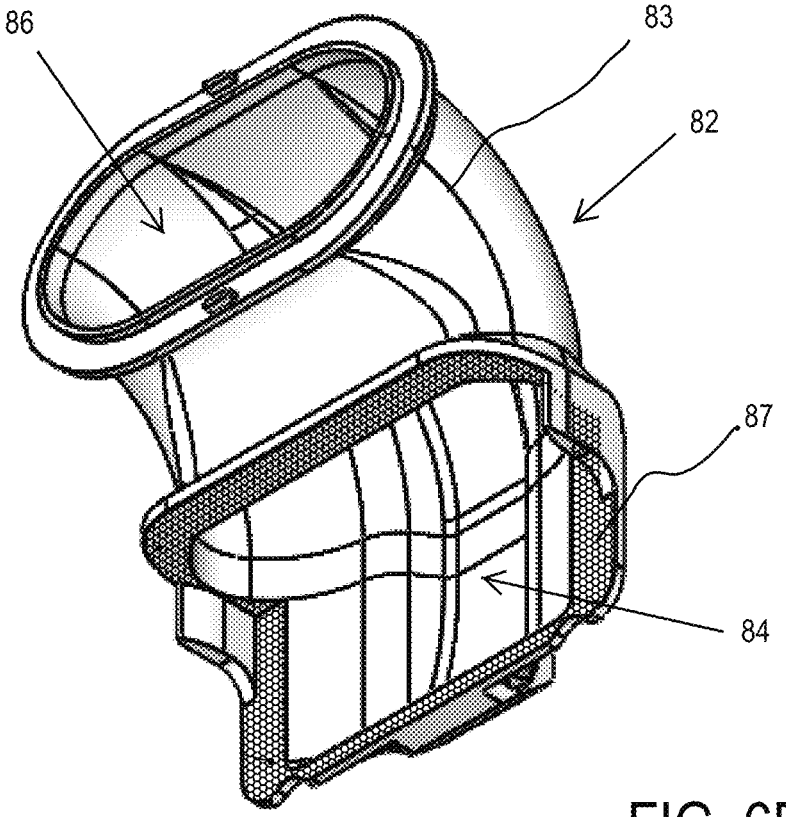
FIGS. 6A and 6B illustrate an inlet duct and an outlet duct, respectively.
Figure 6A:
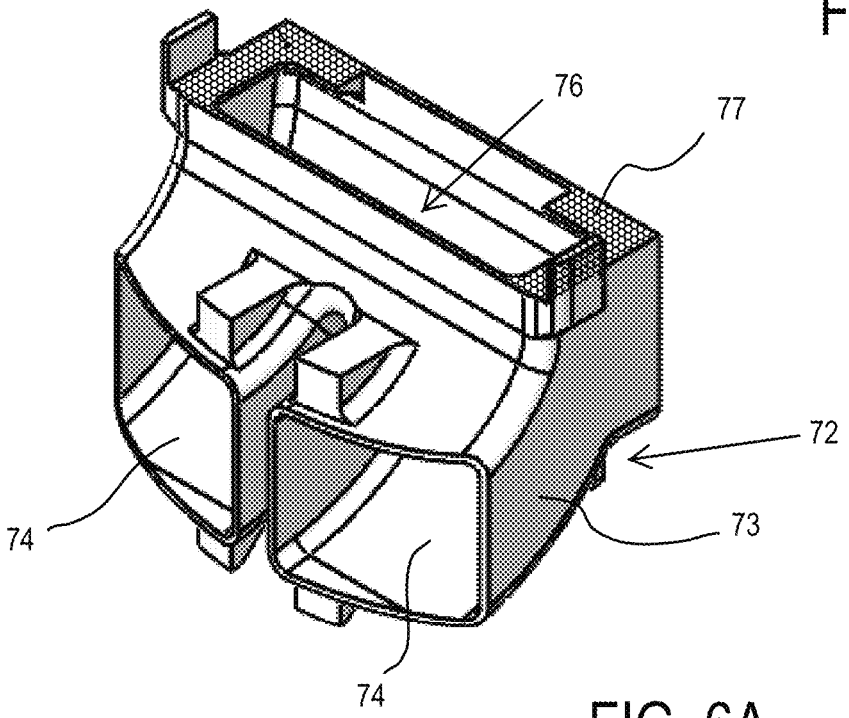

FIG. 6A illustrates a perspective view of a non-limiting embodiment of the inlet duct 72. The inlet duct 72 is a generally hollow structure having a sidewall 73 that extends from an inlet opening 74 to an outlet opening 76. In the illustrated embodiment, the inlet opening 74 includes two openings disposed side-by-side. However, it will be appreciated that a single opening may be utilized. As shown, front edge surfaces of the two inlet openings 74 are curved for substantially flush engagement with the inlet aperture 70 formed through a correspondingly curved shroud 42, when the antenna housing is assembled. This front edge surface may be otherwise configured based on, for example, the configuration of the surface (e.g., shroud) it will engage. Further it will be appreciated that a gasket may be disposed around the periphery or peripheries of the inlet(s) 74. Such a gasket may seal an interface between the inlet and the periphery the inlet aperture 70 in the shroud, when the antenna housing is assembled. The outlet 76 is configured for engagement with an antenna unit. In this regard, the outlet may be contoured to engage a specific antenna unit. In the present embodiment, the peripheral surfaces around the outlet opening contain an adhesive 77 (e.g., pressure sensitive tape) for attaching the inlet duct 72 to the antenna unit. Other connection mechanisms are possible.

FIG. 6B illustrates a perspective view of a non-limiting embodiment of the outlet duct 82. The outlet duct 82 is a generally hollow structure having a sidewall 83 that extends from an inlet opening 84 to an outlet opening 86. The inlet opening 84 is configured for engagement with an antenna unit. In this regard, the inlet opening may be contoured to engage a specific antenna unit. In the present embodiment, the peripheral surfaces around the outlet contain an adhesive 87 for attaching the outlet duct 82 to the antenna unit.

In the illustrated embodiment, both the inlet duct 72 and outlet duct 82 are generally elbow-shaped. That is, each duct 72, 82 has an inlet opening and an outlet opening that are generally disposed in perpendicular planes. This shape allows the ducts to extend to or through the generally vertical sidewall surface (e.g., shroud) of the antenna housing while being able to connect to top and bottom surfaces of the illustrated antenna unit. However, it will be appreciated that the configuration of the ducts may be varied based on a configuration of the antenna housing and/or a configuration of an antenna unit disposed within the housing. What is important is that the ducts are configured to extend from openings in the peripheral or sidewall surface of the antenna housing and extend to a duct that is utilized to cool the antenna. The duct that cools the antenna may be integrally formed with the antenna unit as illustrated above in FIG. 5A. However, this is not a requirement.

Figure 7A:
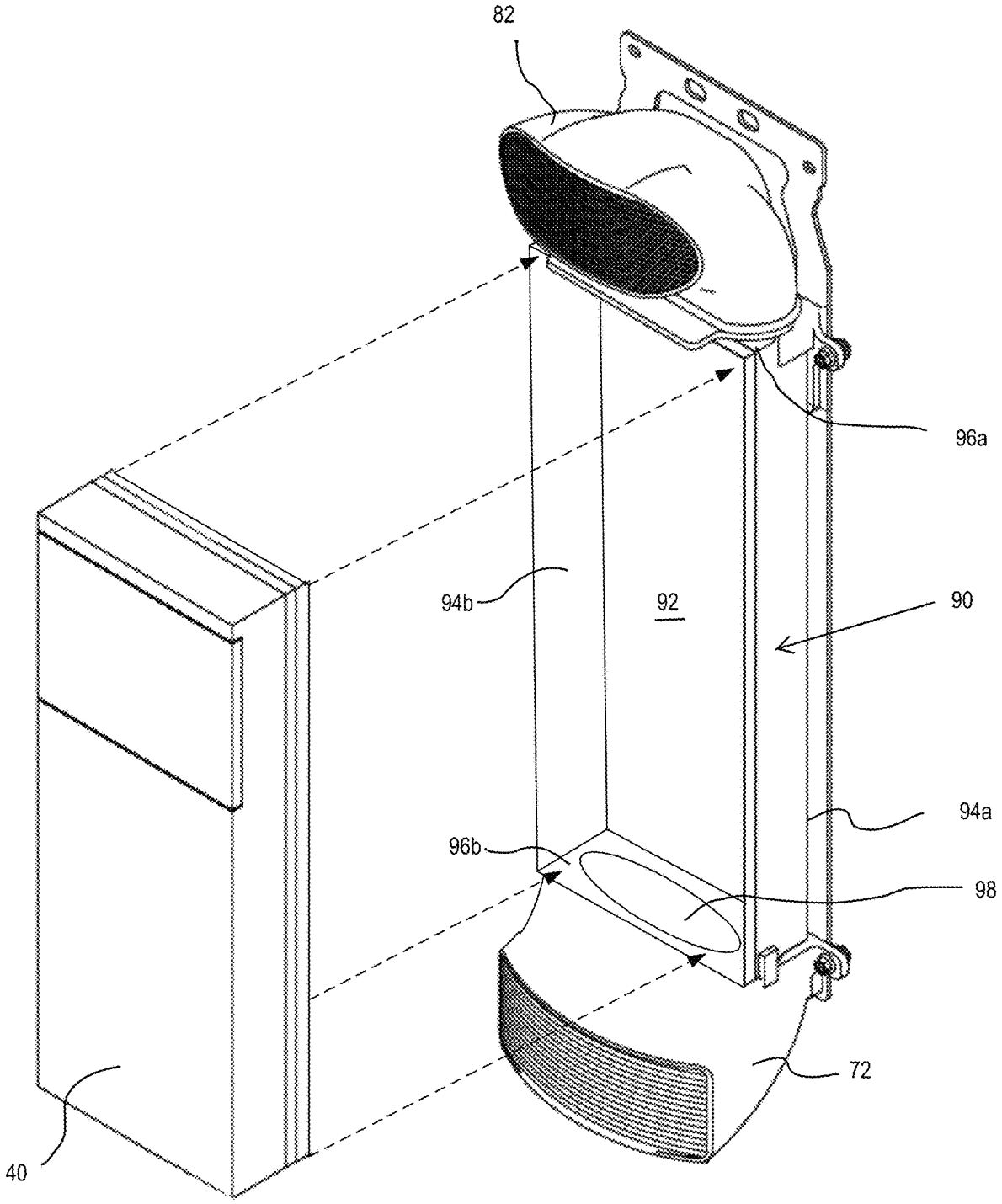
FIGS. 7A and 7B illustrate an inlet duct and outlet duct connected to a central plenum.
Figure 7B:
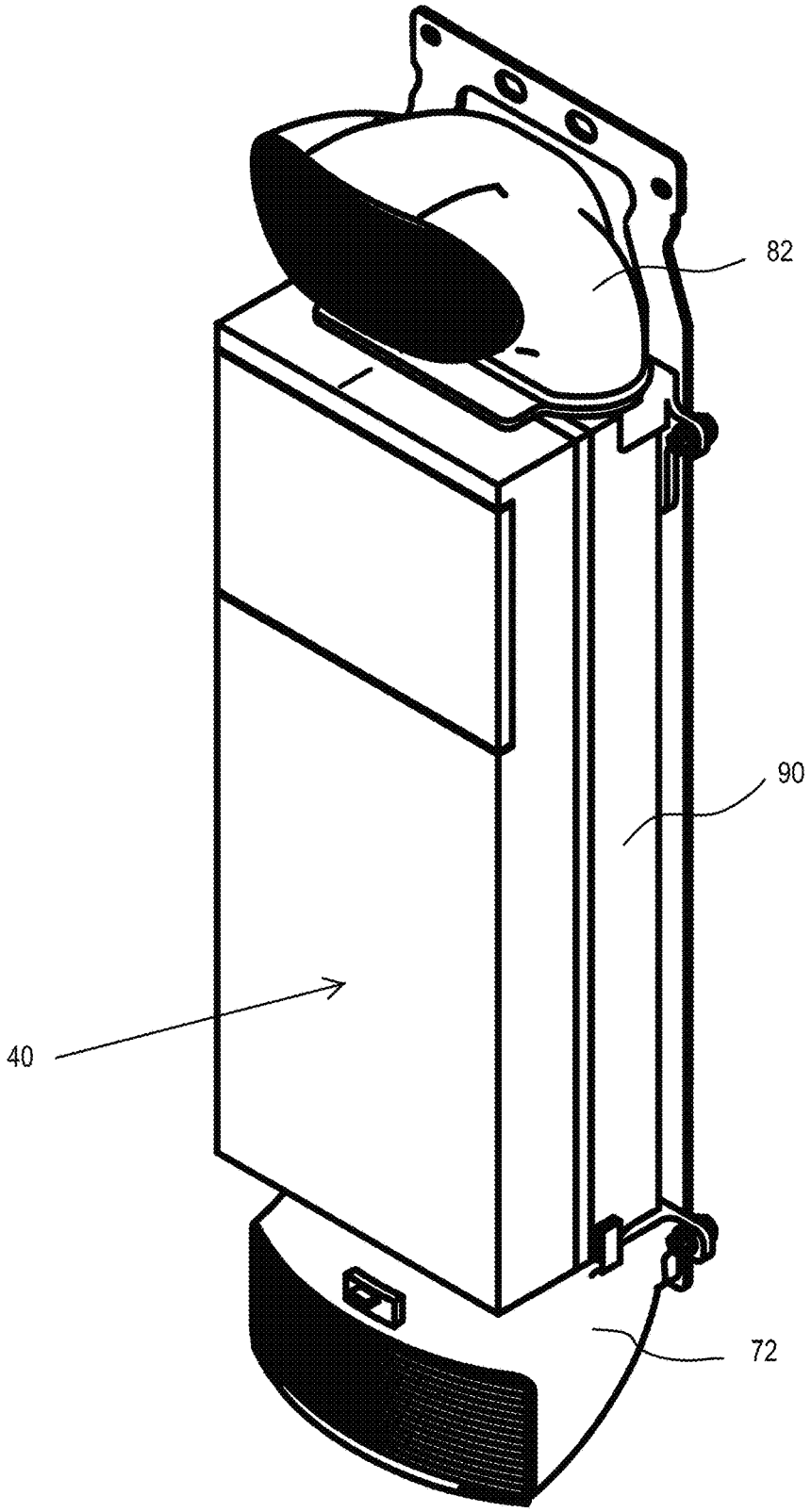

FIGS. 7A and 7B illustrate another embodiment of inlet and outlet ducts that may be utilized with the antenna housing described above. In this embodiment, the ducts 72, 82 attach to the lower and upper ends, respectively, of a central duct or plenum 90 that forms a cooling duct for cooling an antenna unit. In the illustrated embodiment, the plenum 90 is generally box-shaped having a solid rear wall 92, two elongated sidewalls 94*a*, 94*b*, an upper end wall 96*a* and a lower end wall 96*b*. As illustrated, the lower wall 96*b* includes an aperture 98 that fluidly connects the interior of the inlet duct 72 to the interior of the plenum 90. Likewise, the upper wall 96*a* includes an aperture (not shown) that fluidly connects the interior of the outlet duct 82 to the interior of the plenum 90. The front of the illustrated plenum 90, as defined by forward edges of the sidewalls 94*a*, 94*b* and end walls 96*a*, 96*b*, is open to receive a rearward face of an antenna unit 40, which may have a heat dissipating on it rearward surface (e.g., fin plate). The sidewalls and end walls of the plenum may be configured to substantially match the dimensions of the antenna unit 40. A portion of the antenna unit 40 is disposed within or otherwise engages the plenum such that a space remains between the rearward face of the antenna unit and the rear wall 92 of the plenum 90. That is, once the antenna unit engages the plenum, the plenum effectively becomes a sealed duct that carries cooling air between the inlet duct 72 and the outlet duct 82.

The ducting embodiment illustrated in FIG. 7A is well suited for use with antenna units that rely on passive cooling and lack an integral internal cooling duct. However, this embodiment is not limited to any particular antenna unit. The ducting may rely on natural convection to draw air through in inlet duct 72 and expel air out the outlet duct 82. Alternatively, forced convection may be utilized. That is, if an antenna unit lacks a blower/fan, a blower or fan may be incorporated into the ducting. For instance, an optional blower or fan may be incorporated within the inlet duct or the outlet duct. Alternatively, an optional blower/fan may be disposed within the plenum and/or between the plenum and the inlet duct or the outlet duct. Further, it will be appreciated that a blower/fan may likewise be incorporated with the embodiments of FIGS. 4A-5B. For instance, an optional blower 54 (e.g., electric fan) may be incorporated within the inlet duct or the outlet duct 82 as illustrated in FIG. 5A.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. An antenna housing configured for attachment to a pole, comprising:

an enclosure having an upper end, a lower end spaced from the upper end and a sidewall surface extending between the upper end the lower end, wherein the upper end, the lower end and the sidewall surface define an interior area of the enclosure;

an antenna unit at least partially disposed within the interior area, wherein an emitting surface of the antenna unit is directed outward from the interior area of the enclosure;

a first duct having a hollow interior extending between a first inlet end and a first outlet end, wherein the first inlet end opens through the sidewall surface and the first outlet end is disposed within the interior area proximate to a lower portion of the antenna unit;

a second duct having a hollow interior extending between a second inlet end and a second outlet end, wherein the second inlet end is disposed within the interior area proximate to an upper portion of the antenna unit and the second outlet end opens through the sidewall surface.

2. The housing of claim 1, further comprising:

a cooling duct having an inlet end connected to the first outlet end of the first duct and an outlet end connected to the second inlet end of the second duct.

3. The housing of claim 2, further comprising:

a blower at least partially disposed within a fluid path defined by the first duct, the cooling duct and the second duct.

4. The housing of claim 2, wherein an interior of the cooling duct is in fluid communication with a heat rejection surface of the antenna unit.

5. The housing of claim 2, wherein the cooling duct is integrally formed with the antenna unit.

6. The housing of claim 2, wherein the cooling duct includes an opening in a sidewall between the inlet end and the outlet end, wherein the opening is configured to engage a portion of the antenna unit.

7. The housing of claim 1, wherein the emitting surface of the antenna unit is exposed through an antenna aperture through the sidewall surface between the upper end and the lower end.

8. The housing of claim 7, further comprising:

an inlet aperture through the sidewall surface below the antenna aperture and above the lower end of the enclosure; and an outlet aperture through the sidewall surface above the antenna aperture and below the upper end of the enclosure, wherein the inlet aperture is fluidly connected to the first inlet end of the first duct and the outlet aperture is fluidly connected to the second outlet end of the second duct.

9. The housing of claim 1, further comprising:

three antenna units at least partially disposed within the interior area, wherein emitting surfaces of each antenna unit is directed outward from the interior area of the enclosure; and three sets of the first duct and the second duct, wherein each antenna unit is associated with one of the three sets of ducts.

10. An antenna housing configured for attachment to a pole, comprising:

an upper plate;

a lower plate spaced from the upper plate;

at least a first structural support extending between the upper plate and the lower plate, the structural support configured for mounting at least a first antenna thereto; and at least a first shroud extending between the upper plate and the lower plate, wherein the upper plate, the lower plate and the shroud define an interior area of the housing;

an inlet duct having a hollow interior extending between an inlet end opening through the shroud and an outlet end disposed within the interior area of the housing; and an outlet duct having a hollow interior extending between an inlet end disposed within the interior area of the housing and an outlet end opening through the shroud.

11. The housing of claim 10, further comprising:

a cooling duct disposed within the interior area of the housing, the cooling duct having an inlet fluidly connected to the outlet of the inlet duct and an outlet fluidly connected to the inlet of the outlet duct.

12. The housing of claim 11, wherein an interior of the cooling duct is in fluid communication with a heat rejection surface of a wireless antenna.

13. The housing of claim 11, further comprising:

a blower disposed within a fluid path defined by the inlet duct, the cooling duct and the outlet duct.

14. The housing of claim 13, wherein the blower is configured to draw air outside the housing through the inlet duct and exhaust the air out of the outlet duct.

15. An antenna housing configured for attachment to a pole, comprising:

an upper plate;

a lower plate spaced from the upper plate;

at least a first structural support extending between the upper plate and the lower plate;

three antenna units attached to the structural support, each antenna unit having an emitting surface directed outward from an interior area defined between the spaced upper and lower plates;

at least a first shroud extending between the upper plate and the lower plate to at least partially enclose the three antenna units within the interior area;

three sets of ducts, each of the sets of ducts including:

an inlet duct having a hollow interior extending between an inlet end opening through the shroud and an outlet end disposed within the interior area of the housing;

an outlet duct having a hollow interior extending between an inlet end disposed within the interior area of the housing and an outlet end opening through the shroud; and a cooling duct disposed within the interior area of the housing, the cooling duct having an inlet fluidly connected to the outlet of the inlet duct and an outlet fluidly connected to the inlet of the outlet duct, wherein an interior of the cooling duct is in fluid communication with a heat rejection surface of one of the antenna units.

16. The antenna housing of claim 15, wherein each of the sets of ducts further comprises:

a blower disposed within a fluid path defined by the inlet duct, the cooling duct and the outlet duct.

17. The antenna housing of claim 15, wherein each cooling duct is integrally formed with an antenna unit.

18. The antenna housing of claim 15, wherein the emitting surface of each of the antenna units is exposed through a corresponding antenna aperture through the shroud.

19. The housing of claim 18, further comprising:

an inlet aperture through the shroud below each antenna aperture; and an outlet aperture through the shroud above the antenna aperture, wherein each inlet aperture is fluidly connected to an inlet end of an inlet duct and each outlet aperture is fluidly connected to an outlet end of an outlet duct.

* * * * *